United States Patent [19]

Longo et al.

[11] Patent Number: 5,063,323

[45] Date of Patent: Nov. 5, 1991

[54] FIELD EMITTER STRUCTURE PROVIDING PASSAGEWAYS FOR VENTING OF OUTGASSED MATERIALS FROM ACTIVE ELECTRONIC AREA

[75] Inventors: Robert T. Longo, Arcadia; Zaher Bardai, Torrance; Arthur E. Manoly, Rancho Palos Verdes, all of Calif.; Ralph Forman, Rocky River, Ohio; Randy K. Rolph, Redondo Beach, Calif.

[73] Assignee: Hughes Aircraft Company, Los Angeles, Calif.

[21] Appl. No.: 552,643

[22] Filed: Jul. 16, 1990

[51] Int. Cl.[5] ..... H01J 01/30

[52] U.S. Cl. ..... 313/309; 313/310; 313/336; 313/553; 313/554

[58] Field of Search ..... 313/309, 310, 336, 553, 313/554, 549

[56] References Cited

U.S. PATENT DOCUMENTS

| | | | |
|---|---|---|---|
| 3,112,863 | 12/1963 | Brubacker et al. | 313/309 X |
| 3,855,499 | 12/1974 | Yamada et al. | 313/336 X |
| 4,293,790 | 10/1981 | Funk et al. | 313/553 X |
| 4,410,832 | 10/1983 | Smith et al. | 313/336 X |
| 4,721,885 | 1/1988 | Brodie | 313/309 X |
| 4,766,340 | 8/1988 | van der Mast et al. | 313/366 X |

*Primary Examiner*—Donald J. Yusko
*Assistant Examiner*—Ashok Patel
*Attorney, Agent, or Firm*—Terje Gudmestad; Jeannette M. Walder; W. K. Denson-Low

[57] ABSTRACT

Outgassed materials liberated in spaces between pointed field emitter tips and an electrode structure during electrical operation of a field emitter device are vented through passageways to a pump of gettering material provided in a separate space. The passageways may include channels formed through an insulating layer between a base for the field emitters, and the electrode structure, with the channels interconnecting adjacent spaces in a row direction. Where the electrode structure includes a gate electrode layer and an anode layer, similar channels may be formed through an insulator layer provided therebetween. The field emitters may be formed in an arrangement of rows and columns, with the spacing between the columns smaller than the spacing between the rows.

19 Claims, 4 Drawing Sheets

FIELD EMITTER STRUCTURE PROVIDING PASSAGEWAYS FOR VENTING OF OUTGASSED MATERIALS FROM ACTIVE ELECTRONIC AREA

BACKGROUND OF THE INVENTION

1. Field of the Invention

The present invention generally relates to field emitter arrays, and more particularly to a field emitter structure and fabrication process which provide venting of outgassed materials from the active electronic area of the structure.

2. Description of the Related Art

Field emitter arrays typically include a metal/insulator/metal film sandwich with a cellular array of holes through the upper metal and insulator layers, leaving the edges of the upper metal layer (which serves as an accelerator or gate electrode) effectively exposed to the upper surface of the lower metal layer (which serves as an emitter electrode). A plurality of conically-shaped electron emitter elements are mounted on the lower metal layer and extend upwardly therefrom such that their respective tips are located in respective holes in the upper metal layer. If appropriate voltages are applied between the emitter electrode, accelerator electrode, and an anode located above the accelerator electrode, electrons are caused to flow from the respective cone tips to the anode.

This structure is comparable to a triode vacuum tube, providing amplification of a signal applied to the accelerator or gate electrode, and operates best when the space in which the electrodes are mounted is evacuated. The three electrode configuration is known as a field emitting triode or "fetrode". However, numerous other applications for field emitter arrays have been proposed, including extremely high resolution flat panel television displays. A major advantage of the field emitter array concept is that the arrays can be formed by conventional photolithographic techniques used in the fabrication of integrated microelectronic circuits. This enables field emitter elements to be formed with submicron spacing, using process steps integrated with the formation of signal processing and other microelectronic circuitry on a single chip. A general presentation of field emitter arrays is found in an article entitled "The Comeback of the Vacuum Tube: Will Semiconductor Versions Supplement Transistors?", by K. Skidmore, Semiconductor International Industry News, pp. 15–18 (Aug. (1988).

A problem which has remained in conventional field emitter array structures involves the liberation of outgassed materials in the active electronic area of the device. During operation, electrons ejected from the field emitter tips strike the anode material, knocking off molecular particles of trapped gaseous and solid impurity materials. This outgassing effect creates a plasma or ionization in the spaces between the emitter tips and the anode, which seriously degrades the vacuum in the spaces and may cause arcing which can lead to destruction of the device.

SUMMARY OF THE INVENTION

The present invention overcomes the problems created by the liberation of outgassed materials in the active electronic areas of a field emitter structure by providing passageways which enable removal of the materials from the active areas for collection. The present invention further provides a process for fabricating a field emitter structure including venting passageways which are advantageously arranged to facilitate efficient removal of the outgassed materials from the active areas.

In accordance with the present invention, outgassed materials liberated in spaces between pointed field emitter tips and an electrode structure during electrical operation of the device are vented through passageways to a pump or gettering material provided in a separate space. The passageways may include channels formed through an insulating layer between a base for the field emitters, and the electrode structure, with the channels interconnecting adjacent spaces in a row direction. Where the electrode structure includes a gate electrode layer and an anode layer, similar channels may be formed through an insulator layer provided therebetween. The field emitters may be formed in an arrangement of rows and columns, with the spacing between the columns smaller than the spacing between the rows. Holes are formed by anisotropic etching through the anode, gate electrode, and insulator layers down to the base. Subsequent isotropic etching of the insulator layers through the holes in the anode and gate electrode layers is controlled to cause sufficient undercutting in the insulator layers that adjacent holes merge together only in the row direction to form the channels.

The field emitter structure may further include a structurally supporting open mesh screen adhered to the opposite side of the base. The base may be formed with at least one hole therethrough which constitutes part of the passageways, and which may be covered with the mesh screen.

These and other features and advantages of the present invention will be apparent to those skilled in the art from the following detailed description, taken together with the accompanying drawings, in which like reference numerals refer to like parts.

DETAILED DESCRIPTION OF THE INVENTION

Figure 1:
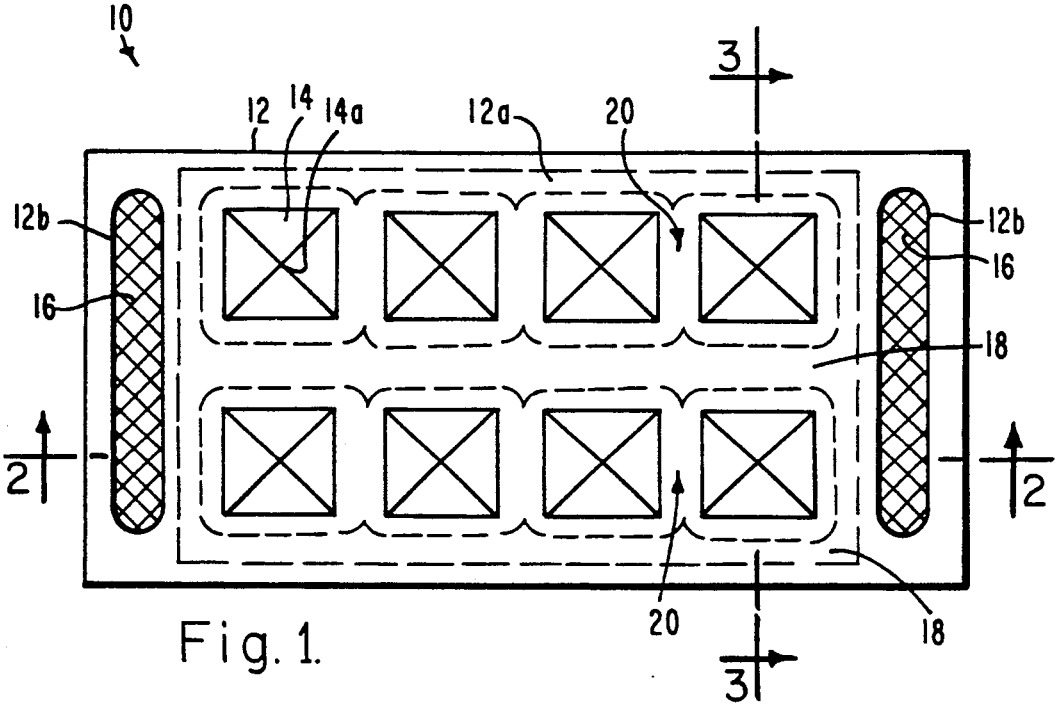
FIG. 1 is a simplified plan view illustrating an arrangement of field emitters formed on a base in accordance with the present invention.

Referring now to FIGS. 1 to 4 of the drawing, a field emitter structure or device embodying the present invention is generally designated as 10, and includes an electrically conductive base 12 made of, for example, a metal or polycrystalline silicon material. A plurality of pointed field emitters 14 upstand from a surface 12*a* of the base 12, and have pointed tips 14*a*. The field emitters 14 are made of an electrically conductive material such as molybdenum or polycrystalline silicon, and are in ohmic connection with the base 12. The field emitters 14 may be coated with a low work function material such as titanium carbide, which facilitates electron emission from the tips of the field emitters.

Field emitter arrays have been heretofore formed by two processes, the first of which is described in an article entitled "PHYSICAL PROPERTIES OF THIN-FILM FIELD-EMISSION CATHODES WITH MOLYBDENUM CONES", by C.A. Spindt et al, Journal of Applied Physics, vol. 47, no. 12, pp. 5248–5263 (Dec. 1976). The main steps of the process include depositing an insulator layer and a metal gate electrode layer on a silicon substrate, and forming holes through these layers down to the substrate. Molybdenum is deposited onto the substrate through the holes by electron beam evaporation from a small source. The size of the holes progressively decreases due to condensation of molybdenum on their peripheries. A cone grows inside each hole as the molybdenum vapor condenses on a smaller area, limited by the decreasing size of the aperture, and terminates in a point which constitutes an efficient source of electrons.

The second method of fabricating a field emitter array is disclosed in U.S. Pat. No. 4,307,507, issued Dec. 29, 1981, entitled "METHOD OF MANUFACTURING A FIELD-EMISSION CATHODE STRUCTURE", to H. Gray et al. In this method, a substrate of single crystal material is selectively masked such that the unmasked areas define islands on the underlying substrate. The single crystal material under the unmasked areas is orientation-dependent etched to form an array of holes whose sides intersect at a crystallographically sharp point. Following removal of the mask, the substrate is covered with a thick layer of material capable of emitting electrons which extends above the substrate surface and fills the holes. Thereafter, the material of the substrate underneath the layer of electron-emitting material is etched to expose a plurality of sharp field-emitter tips.

The field emitters 14 are shown as having a pyramidal shape as formed in accordance with the process disclosed by Gray et al. Alternatively, the field emitters 14 may have a conical shape as formed in accordance with the article to Spindt et al.

Although only eight field emitters 14 are shown in the drawing for clarity of illustration, in an actual device a large number of field emitters will be formed on a base and electrically operated in parallel to provide a useful magnitude of electrical current. The field emitters 14 are formed on the base 12 in an arrangement of horizontal rows and vertical columns. In accordance with an important feature of a preferred fabrication method of the invention, the spacing between adjacent field emitters 14 in the column direction (horizontal spacing between columns) is smaller than the spacing between adjacent field emitters in the row direction (vertical spacing between rows).

Further illustrated in FIG. 1 are holes in the shape of elongated slots **12*b* formed through the base 12 between the field emitters 14 and the respective edges of the base 12. An open mesh screen 16 may be optionally adhered to an opposite surface 12*c* of the base 12, as visible in FIGS. 2 and 3, to provide support for the base 12 during fabrication and operation of the device. The screen 16 may preferably be made of a metal such as molybdenum or copper, and be in ohmic connection with the base 12 and field emitters 14**.

Electrically insulative support members in the form of upstanding walls 18 are formed on the surface **12*a* between adjacent rows of field emitters 14, as illustrated in broken line in FIG. 1. The walls 18 define channels 20 therebetween, in which the rows of field emitters 14** are located respectively.

A gate electrode layer 22 made of, for example, an electrically conductive metal such as gold, is supported above the surface **12*a* by the walls 18. The electrode layer 22 has holes 22*a* formed therethrough, aligned above the tips 14*a* of the respective field emitters 14. The holes 22*a* constitute at least part of respective open spaces 24 provided between the tips 14*a* of the field emitters 14 and the edges of the holes 22*a* of the electrode layer 22. The open spaces 24 merge together and are thereby interconnected in the row direction of the structure 10 to constitute the channels 20**.

Electrically insulative supporting walls 26, which are essentially similar to the walls 18, are formed on the electrode layer 22, and support an anode layer 28 thereon. The anode layer 28 may be formed of an electrically conductive metal such as gold. Holes **28*a* are formed through the anode layer 28, in alignment with the holes 22*a* and field emitters 14. If desired, an optional electrically conductive cover layer 30 may be adhered to the anode layer 28 in ohmic connection therewith. The walls 26 define channels 32 therebetween which are aligned over the channels 20**.

The structure 10 further includes an enclosure or container 34 in which the base 12 and elements formed thereon are mounted. The container 34 may be made of any suitable material, and includes a base 36 and a cover 38. Although not shown, leads may be provided for connection of the base 12, gate electrode layer 22, and anode layer 28 to an external circuit. The container 34 is preferably evacuated, and hermetically sealed.

During operation of the structure 10, an electrical potential which is positive with respect to the base 12 is applied to the anode layer 28. With a positive potential above a predetermined cutoff value applied to the gate electrode layer 22, electrons will be emitted from the tips **14*a* of the field emitters 14 and be accelerated to the anode layer 28. The conductive cover layer 30, if provided, constitutes an integral anode structure in combination with the anode layer 28. The magnitude of electron flow depends on the potential applied to the gate electrode layer 22. Increasing the gate electrode potential produces an increase in the anode current, with a gain or amplification factor inherent in the configuration enabling the structure 10** to function as an amplifier in a triode configuration.

The electrons emitted from the field emitters 14 strike the anode layer 28 and cover layer 30 with sufficient energy to cause outgassing or liberation of trapped gaseous and solid impurity materials into the active electronic areas between the field emitter tips **14*a* and the anode layer 28**. Unless removed, the outgassed materials may cause sufficient ionization or plasma formation in these areas to cause serious malfunction or destruction of the device as discussed above.

Figure 2:
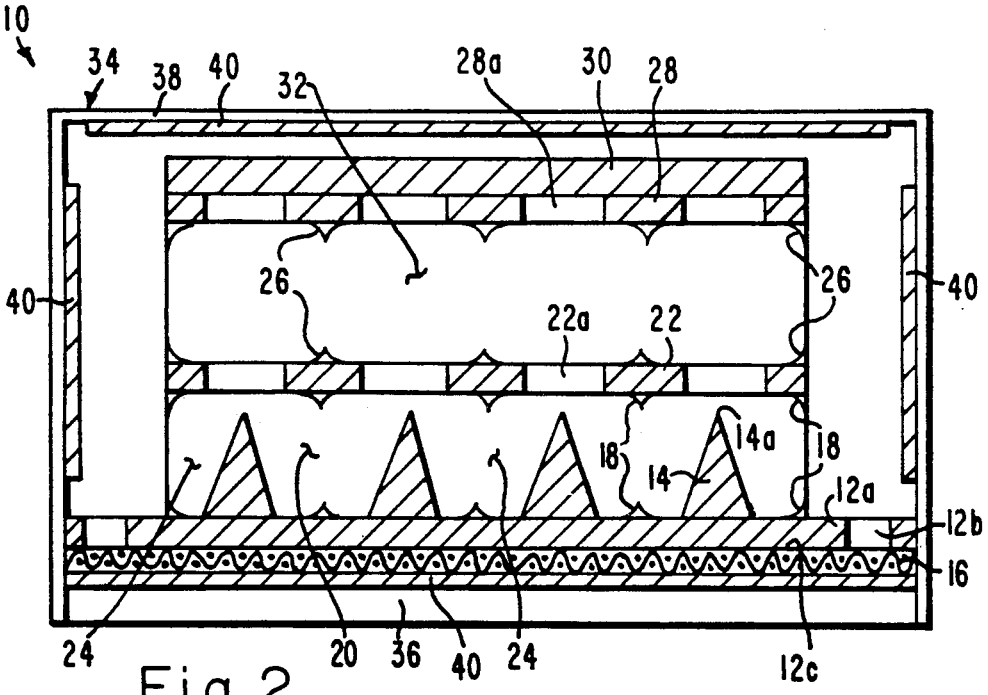
FIG. 2 is a section taken on a line II—II of FIG. 1, but illustrating a complete field emitter structure embodying the invention.
Figure 3:
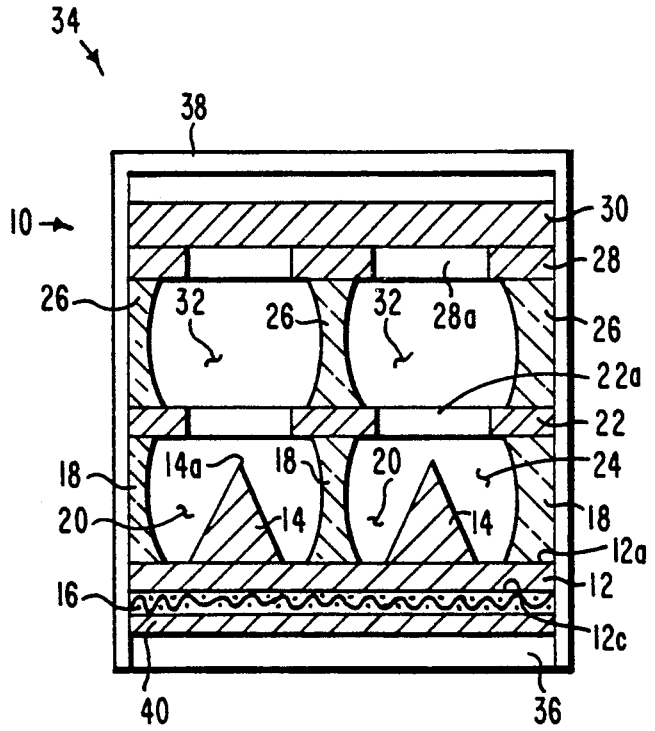
FIG. 3 is similar to FIG. 2, but is taken on a line III—III of FIG. 1.

In accordance with an important feature of the present invention, the channels 20 and 32 constitute at least part of a network of passageways which enable venting or removal of the outgassed material from the electronically active areas to a separate area in which a pump, or gettering means, which functions as a pump, is provided for collection of the materials. As best seen in FIG. 2, a gettering material 40 such as barium, which acts as a concentration gradient driven pump, is coated on the upper and side walls of the interior of the cover 38. The outgassed materials in the active electronic areas below the holes 28*a* in the anode layer 28, due to their initial high concentration in these areas, are pumped or diffuse through the channels 20 and 32 to the externally located gettering material 40 which traps the materials. The venting and collection process continues as long as a concentration gradient exists between the active electronic areas, and the areas on which the gettering material 40 is formed.

In addition to the inner walls of the cover 38, the gettering material 40 may be formed on the inner surface of the base 36 of the container 34, below the mesh screen 16. Outgassed materials will be additionally vented from the channels 20 and 32, through the holes 12*b* formed through the base 12, and the mesh screen 16, to the gettering material 40 on the base 12.

These venting paths or passageways may be provided singly, or in any desired combination. It is further within the scope of the invention to replace the gettering material with an external pumping means, which communicates with the channels 20 and 32 through a hole (not shown) formed through the container 34. As a yet further modification of the pumping means, most materials, with the notable exception of elements with completely filled atomic shells, are chemically reactive in atomically pure form. By making the inner walls, or at least part of the inner walls, of the container 34 extremely clean or atomically pure, the atomically pure surfaces will exhibit a gettering effect in a manner similar to the material 40.

Figure 5:
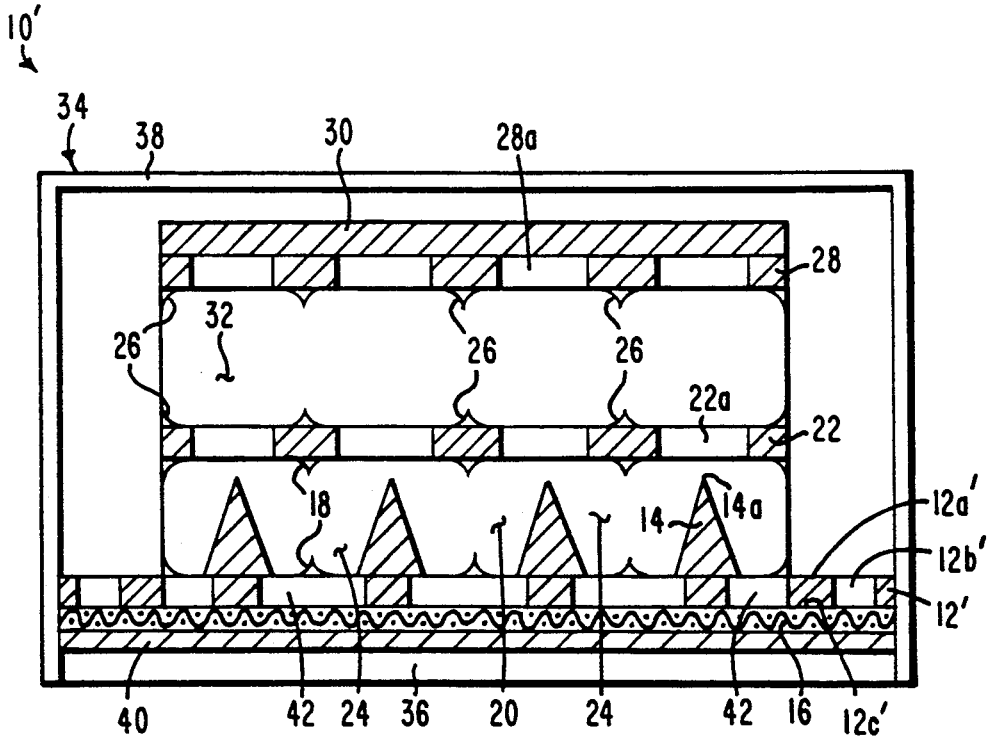
FIG. 5 is similar to FIG. 2, but shows a modified embodiment of the present structure.
Figure 4:
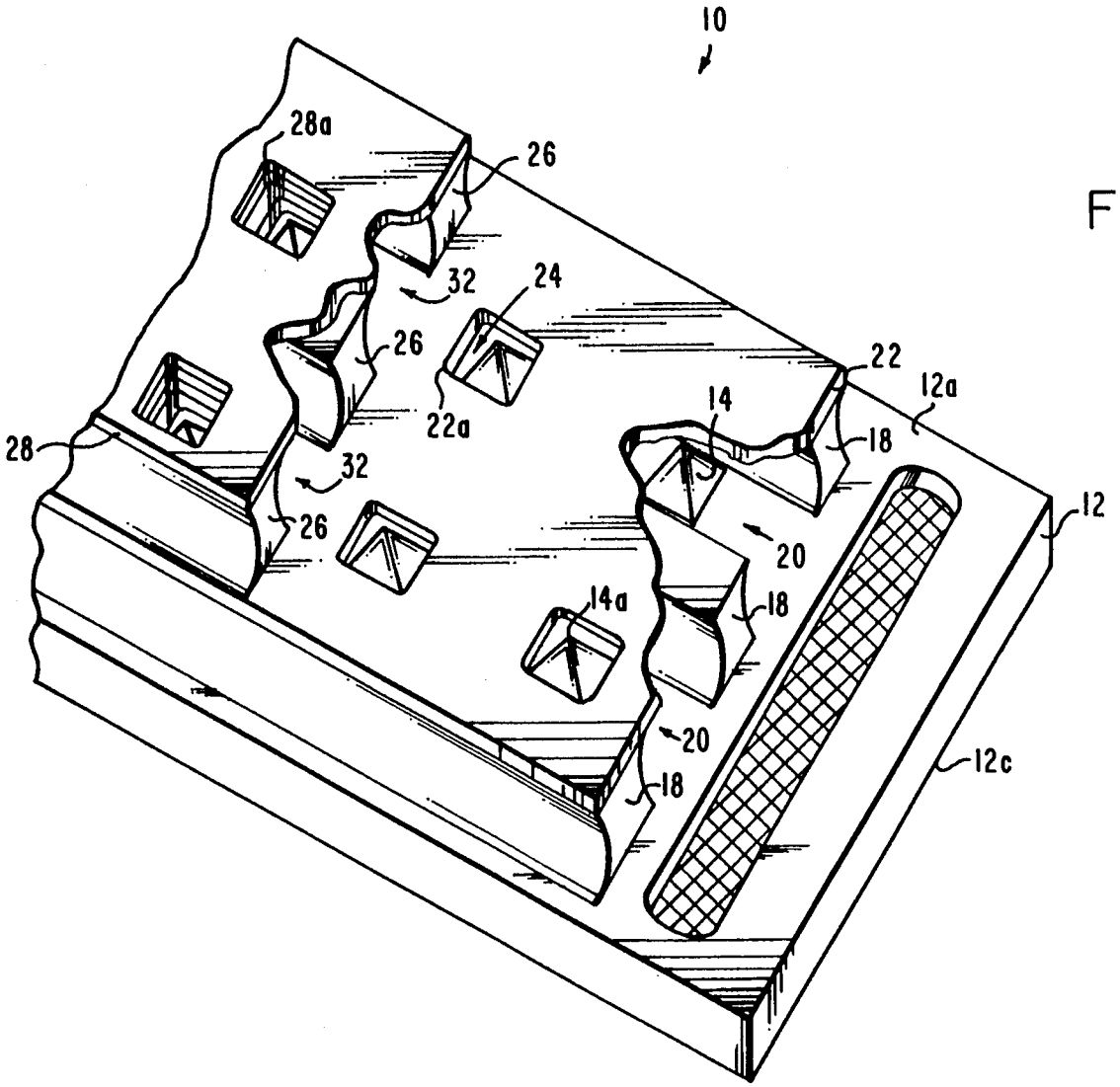
FIG. 4 is a fragmentary perspective view of the present field emitter structure.

FIG. 5 illustrates a modified field emitter structure 10' embodying the present invention, in which like elements are designated by the same reference numerals, and corresponding but modified elements are designated by the same reference numerals primed. The structure 10' differs from the structure 10 in the provision of holes or slots 42, which are formed through the base 12' by plasma etching or the like, and communicate directly with the spaces 24. The slots 42 enable venting of outgassed materials therethrough from the spaces 24 to the gettering material 40 provided on the base 36, and may be provided in addition to, or as an alternative to the channels 20. Where the slots 42 are provided without the channels 20 and 32, they constitute passageways in combination with the open mesh screen 16 which interconnect the open spaces 24.

Figure 6A:
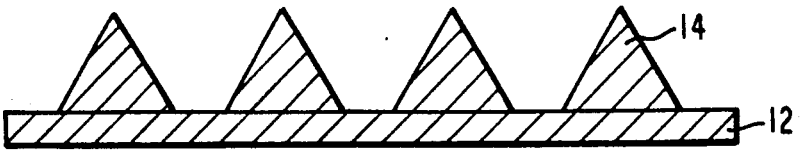
FIGS. 6*a* to 6*d* are sectional views illustrating a process for fabricating a field emitter structure in accordance with the present invention.
Figure 6B:
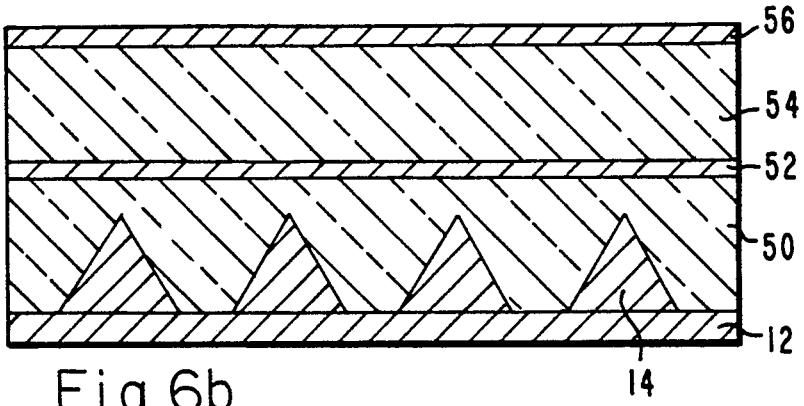

FIGS. 6*a* to 6*d* illustrate a preferred process for fabricating the field emitter structure 10 in accordance with the present invention. In FIG. 6*a*, the field emitters 14 are formed on the base 12 using a process disclosed in the references discussed above, or any other process which will produce an equivalent result. In FIG. 6*b*, an electrically insulative layer 50 of, for example, silicon dioxide, is formed over the base 12 to cover the field emitters 14. A conductive metal layer 52 of, for example, gold, is formed over the insulative layer 50. A second insulative layer 54 is formed over the conductive layer 52, and a second conductive layer 56 is formed over the insulative layer 54.

Figure 6C:
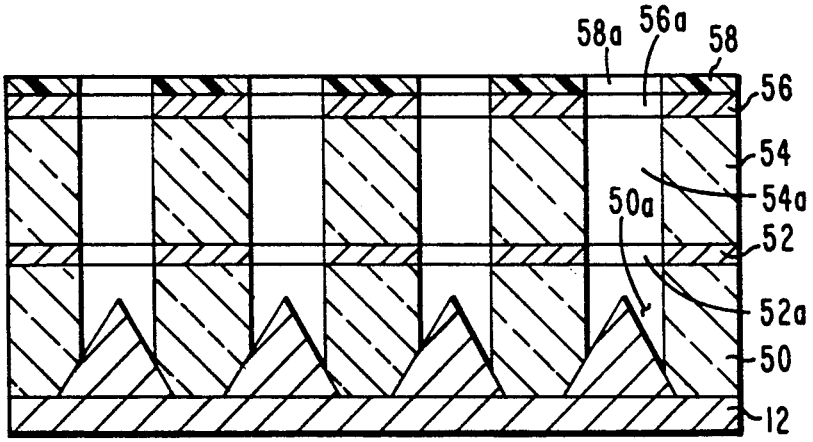

In the step illustrated in FIG. 6*c*, a layer 58 of a photoresist material such as Shippley AZ 1370 photoresist, is formed over the conductive layer 56 using a photolithographic technique employing a mask (not shown), which leaves holes 58*a* through the layer 58 aligned over the field emitters 14. An etching process which is substantially anisotropic, such as plasma etching employing a substance that does not etch the photoresist layer 58, is used to etch substantially vertical holes 56*a*, 54*a*, 52*a*, and 50*a* through the layers 56, 54, 52, and 50 respectively. Following this step, the photoresist layer 58 may be removed.

Figure 6D:
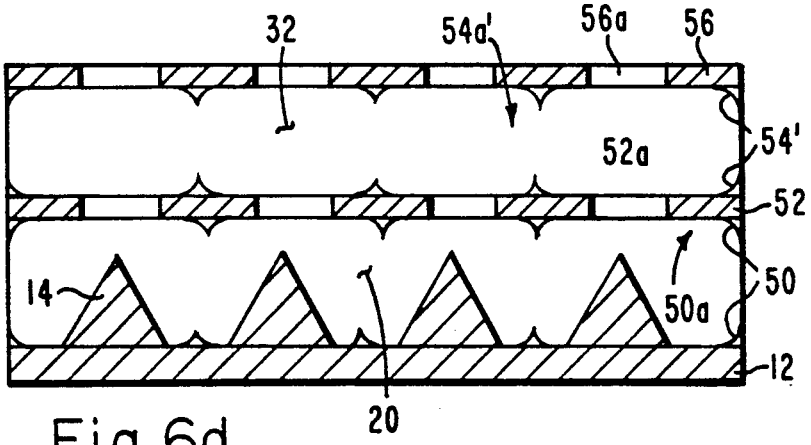

As illustrated in FIG. 6*d*, an etching process which is at least partially isotropic, such as wet etching employing a material such as $CF_4$, $NF_3$, or $SF_2$, that does not etch the conductive layers 52 and 56, is used to etch the insulative layers 50 and 54. In accordance with an important feature of the present invention, the etching step illustrated in FIG. 6*d* is controlled such that the holes 50*a* and 54*a* in the insulative layers 50 and 54 are expanded to undercut the holes 52*a* and 56*a* in the conductive layers 52 and 56 to an extent such that adjacent holes 50*a* and 54*a* merge together only in the row direction of the structure 10 to form the channels 20 and 32 respectively. This occurs because the spacing between the field emitters 14 in the column direction is smaller than the spacing in the row direction. An equal amount of etching in both directions will cause adjacent holes 50*a* and 54*a* to merge together in the row direction, but not in the column direction, due to the larger spacing between the holes in the row direction. In FIG. 6*d*, the layers and holes which have been modified by the isotropic etching step are designated by the same reference numerals primed. The layers 50, 52, 54, and 56, and the holes formed therethrough, correspond to the elements 18, 22, 26, and 28 illustrated in FIGS. 1 to 4 respectively.

While several illustrative embodiments of the invention have been shown and described, numerous variations and alternate embodiments will occur to those skilled in the art, without departing from the spirit and scope of the invention. Accordingly, it is intended that the present invention not be limited solely to the specifically described illustrative embodiments. Various modifications are contemplated and can be made without departing from the spirit and scope of the invention as defined by the appended claims.

We claim:

1. A field emitter structure, comprising:

an electrically conductive base;

a plurality of electrically conductive, pointed field emitters upstanding from a surface of the base;

electrode means supported above said surface, portions of the electrode means adjacent to the points of the field emitters being separated therefrom by open spaces respectively; and passageway means interconnecting said open spaces, said passageways and open spaces being formed through an insulating layer between the base and said electrode means.

2. A structure as in claim 1, further comprising pumping means for pumping outgassed materials produced during electrical operation of the structure out of the spaces, the pumping means being separated from the spaces and connected thereto by the passageway means.

3. A structure as in claim 2, in which the pumping means comprises gettering means.

4. A structure as in claim 3, in which the gettering means comprises a gettering material.

5. A structure as in claim 4, in which the gettering material comprises barium.

6. A structure as in claim 3, in which the gettering means comprises a material having a surface which is initially atomically pure.

7. A structure as in claim 2, further comprising an evacuated container which hermetically encloses the base, the field emitters, electrode means, open spaces, passageway means, and pumping means.

8. A structure as in claim 1, in which the base is formed with a hole therethrough which interconnects with the passageway means.

9. A structure as in claim 8, further comprising an open mesh screen which is adhered to the surface of the base opposite to said surface, and covers the hole.

10. A structure as in claim 9, in which the screen is substantially coextensive with and supports the base.

11. A structure as in claim 1, in which the passageway means comprises a hole formed through the base which interconnects with said open spaces.

12. A structure as in claim 11, further comprising an open mesh screen which is adhered to a surface of the base opposite to said surface, and covers the hole.

13. A structure as in claim 12, in which the screen is substantially coextensive with and supports the base.

14. A structure as in claim 1, further comprising electrically insulative support means for supporting the electrode means above said surface.

15. A structure as in claim 14, in which the support means comprises a plurality of support members upstanding from said surface, the passageway means extending around the support members.

16. A structure as in claim 15, in which the field emitters are arranged in rows, the support members comprising walls extending between adjacent rows, said open spaces between adjacent upstanding walls being interconnected to form channels which constitute at least part of the passageway means.

17. A structure as in claim 16, in which said portions of the electrode means adjacent to the points of the field emitters have holes formed therethrough which are aligned over the respective field emitters, the holes constituting at least part of the respective open spaces.

18. A structure as in claim 16, in which the base is formed with a hole therethrough adjacent to ends of the channels.

19. A structure as in claim 1, further comprising:

anode means, the electrode means including a gate electrode means which is disposed between the field emitters and the anode means; and a plurality of electrically insulative support members for supporting the gate electrode means and anode means above said surface, the passageway means extending around the support members.

* * * * *